US006520266B2

(12) United States Patent
Bongers-Ambrosius et al.

(10) Patent No.: US 6,520,266 B2
(45) Date of Patent: Feb. 18, 2003

(54) PERCUSSION ELECTRICAL HAND-HELD TOOL

(75) Inventors: Hans-Werner Bongers-Ambrosius, Munich (DE); Martin Richter, Freising (DE); Konrad Artmann, Wörthsee (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/902,676

(22) Filed: Jul. 11, 2001

(65) Prior Publication Data

US 2002/0056558 A1 May 16, 2002

(30) Foreign Application Priority Data

Jul. 14, 2000 (DE) ..... 100 34 359

(51) Int. Cl.[7] ..... B25D 9/00

(52) U.S. Cl. ..... 173/2; 173/201; 173/216; 173/115

(58) Field of Search ..... 173/201, 216, 173/2, 115

(56) References Cited

U.S. PATENT DOCUMENTS 4,365,962 A * 12/1982 Regelsberger ..... 173/104
5,653,294 A * 8/1997 Thurler ..... 173/13
5,775,440 A * 7/1998 Shinma ..... 173/109
5,984,020 A * 11/1999 Meyer et al. ..... 173/171

FOREIGN PATENT DOCUMENTS

DE 3505544 * 8/1986
EP 063725 * 11/1982

* cited by examiner

*Primary Examiner*—Ted Kavanaugh
(74) *Attorney, Agent, or Firm*—Sidley Austin Brown & Wood, LLP

(57) ABSTRACT

A percussion electrical hand-held tool including a housing (10), a percussion element (2) located in the housing, and a planetary gear unit (5) located in the housing (10) for converting a rotational movement (107) of the drive shaft (ω) of the hand-held tool (8) into a reciprocating movement (υ) of the percussion element (2), with the planetary gear unit (5) including a sun gear (6) changing of a setting (α) of which provides for adjusting of an impact amplitude of the reciprocating movement (α) of the percussion element (2), and control unit located in the housing (10) for adjusting the impact amplitude in accordance with a manual axial force applied to the handle of the hand-held tool (8).

8 Claims, 2 Drawing Sheets

Fig. 1
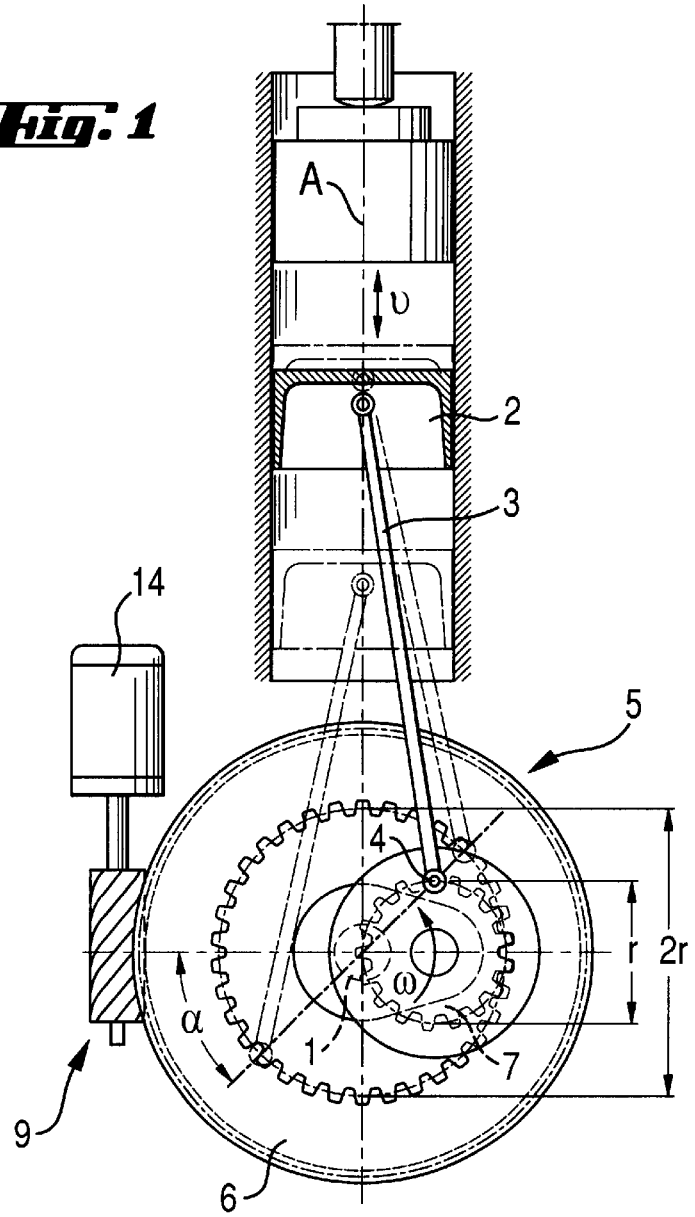
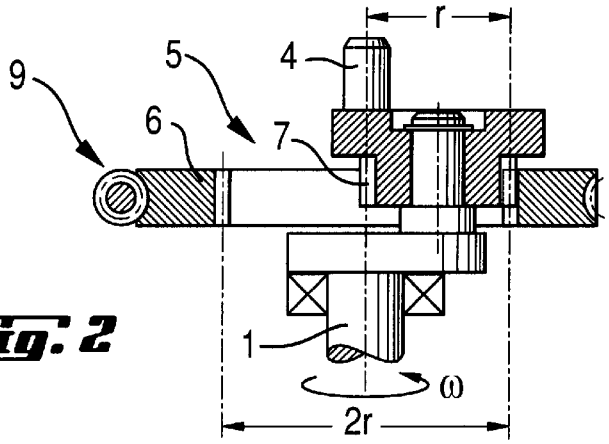
Fig. 2

PERCUSSION ELECTRICAL HAND-HELD TOOL

BACKGROUND OF THE INVENTION

1. Field of the Invention

The present invention relates to a percussion electrical hand-held tool such as, e.g., hammer drill or chisel hammer, and in particular, to percussion electrical hand-held tool with a pneumatic percussion mechanism.

2. Description of the Prior Art

In percussion electrical hand-held tools, a rotational movement, which is generated by the electromotor of an electrical hand-held tool, is transformed, at least partially, by suitable transformation means, in an oscillating or percussion translational movement. Usually, wobbling oscillations are transformed into oscillations along an oscillation axis that is parallel to the drive shaft, and eccentric oscillations are transformed into oscillations along an axis extending transverse to the drive shaft. In most cases, the oscillation movement is transmitted in a pneumatic percussion mechanism via a driving piston to a gas spring, a percussion piston and, finally, to the working tool. In hammer drills, additionally, a rotational movement is transmitted, via a suitable gear unit, to the working tool spindle. In this case, the ratio of the oscillation frequency or the number of blows applied to the working tool to the rotational speed is maintained constant. Optionally, this ratio can be made discretely switchable from one value to another.

European Publication EP 759 341 discloses use in a hand-held tool of a free impact automatic action which provides, with the use of appropriate means, e.g., an axially displaceable switching sleeve that opens the valves of the percussion mechanism, for a discrete, optionally stepwise, interruption of impacts upon reduction of axial operational pressure applied to the working tool. In the disclosed tool, a constant control of the impact energy by a user is not possible.

Japanese Publication JP 414653/90 discloses use of a planetary gear unit for a stepwise change-over of the rotational speed of the working tool spindle. In the tool discloses in the Japanese Publication, a constant adjustment of the number of impacts in accordance with the rotational speed of the working tool spindle is not possible.

German Publication DE 35 05 544 discloses a hand-held tool in which the oscillation amplitude is constantly adjusted by adjusting an axial position of an eccentric, with the eccentricity being constantly changed by an inclined eccentric journal.

European Publication EP-063 725 discloses a hand-held tool in which a planetary gear unit is used for driving an eccentric journal. In this planetary gear unit, the dimension of the planetary gear and the sun gear, which has an inner toothing and within which the planetary gear is displaceable, are so selected that a rectilinear leg of trajectory follows each point on the pitch circle of the planetary gear. By rotating the sun gear 90°, the piston stroke can be changed from a full stroke, which corresponds to the pitch circle diameter of the sun gear, to almost zero. For a continuous adjustment of the amplitude of the oscillation or reciprocating movement, the sun gear is secured in a respective angular position with a self-locking worm gear unit or with a radially extending adjusting handle.

In the electrical hand-held tool, it is customary to continuously control the rotational speed by controlling the driving power with an electronic phase-controlling means arranged in the current feed circuit. The phase-controlling means is controlled with a finger-actuatable pressure knob arranged in the tool handle, dependent on the immersion depth of the knob. The rotational speed is controlled to provide for smooth start of the hand-held tool or for control of the rotational speed by the user.

German Publication DE 195 03 526 discloses a hand-held tool in which the tool handle is supported in a position transverse to the working tool axis and is rotatable relative thereto with a possibility of being offset relative thereto. This permits the use of the obtained limited degree of freedom along the working tool axis for damping of the vibrations.

The object of the present invention is to provide for continuous control by the user of the impact power in the hand-held tools independently of the rotational speed of the tool drive.

SUMMARY OF THE INVENTION

This and other objects of the present invention, which will become apparent hereinafter are achieved by providing a percussion electrical hand-held tool in which the amplitude of the reciprocating or percussion movement or impact amplitude is adjusted in accordance with a manual axial force applied to the tool handle.

Essentially, according to the present invention a planetary gear unit is used as crank gear unit. In the planetary gear unit, the dimensions of the planetary gear and the sun gear, which has an inner toothing and within which the planetary gear is displaceable, are so selected that a rectilinear leg of trajectory follows each point on the pitch circle of the planetary gear.

The eccentric journal of the planetary gear is connected by a connecting rod with impact-producing means, e.g. a percussion piston, that reciprocates parallel to the working tool axis. In this case, the angular position of the continuously adjustable sun gear depends on the force applied to the handle along the working tool axis.

As a result of a constant adjustment of the sun gear, the angle of the rectilinear reciprocating movement of the eccentric journal is likewise constantly adjusted. Thus, with respect to a predetermined rotational speed, the impact energy is constantly adjusted by adjusting the impact amplitude. This solution encompasses disconnection of the idle impact at the setting of the sun gear in the vicinity of zero.

The setting, i.e., the angular position, of the sun gear is effected with an adjustment mechanism mechanically, pneumatically, or electronically connected with the tool handle. The adjustment mechanism is formed as a self-locking mechanism so that the forces, which act. in a direction opposite the direction of action of the reciprocating movement generating forces, would act on the entire housing and not predominantly on the handle. The displacement region of the handle, which actually controls the impact power, lies in the range of up to 3 cm and provides for change of the sun gear setting up to $\pi/2$.

Advantageously, as an adjusting means, a self-locking, worm gear unit is used. The worm gear unit comprises a worm gear toothing provided on the outer circumference of the sun gear. The means, which includes a gear unit, for driving the worm gear unit are advantageously controlled by servo control means, using the power available in the hand-held tool. For adjusting the sun gear setting, an available kinetic drive power is used. The kinetic drive power is provided by the available pneumatic compression power or by a controllable adjusting motor driven by the electrical power available in the hand-held tool.

When a controllable adjusting motor is used, the impact power can be controlled by a user or a microcontroller according to desired operational characteristics. According to the invention, the actual impact power applied to the working is adjusted in accordance with the data obtained with displacement, pressure, and acceleration sensors to arrive at a set impact power.

The control of the set impact power by controlling the impact amplitude is effected, advantageously, independent from the control of the drive power with the pressure knob, by measuring the axial force applied to the handle of the hand-held tool, as this axial force innately corresponds to the wishes of the user. To this end, advantageously, the handle is axially displaced by a limited amount against an axial counterforce toward the working tool or the workpiece. Thereby, the setting of the sun gear is changed, increasing the percussion power.

Advantageously, the handle is secured to the tool housing, radially offset with respect to the working tool axis, with a hinge arranged transverse to the working tool axis. The axial force is measured indirectly, in accordance with the handle displacement, or directly by a piezo force sensor and communicated to the microcontroller as a set value. The microcontroller calculates the setting of the sun gear in accordance with a readable by the controller performance diagram in a form of a suitable non-linear mapping of the axial force or of the handle displacement. The calculated setting of the sun gear, which provides for the necessary impact power, is effected by an adjusting motor.

Advantageously, the calculation is effected in accordance with further suitable characteristic values such as rotational speed, torque, current and acceleration. Optionally, the tool type and size also can be taken into consideration for achieving an optimal and reliable operation in accordance with the readable by the controller, performance diagram.

However, the proper weight of the tool, the operational direction, and the gravity acceleration, which depends on its weight, can adversely affect the determination of the set value of the impact energy. To prevent the adverse effect of these factors, the operational direction is determined by a gradient sensor, and with the proper weight being known, the microcontroller calculates the true, desired set value of the impact power. To this end, the gradient sensor is connected with the microcontroller. The microcontroller corrects the real, measured axial force applied to the handle in accordance with a retaining force which corresponds to the proper weight of the hand-held tool multiply by the cosine of an angle formed by the operational direction of the tool and the direction of the gravity acceleration.

The novel features of the present invention, which are considered as characteristic for the invention, are set froth in the appended claims. The invention itself, however, both as to is construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 1 a diagramatic view illustrating the principle of obtaining an oscillation movement;

FIG. 2 a schematic view showing a planetary gear used for obtaining an oscillation movement.

DETAILED DESCRIPTION OF THE PREFERRED EMBODIMENTS

Figure 3:
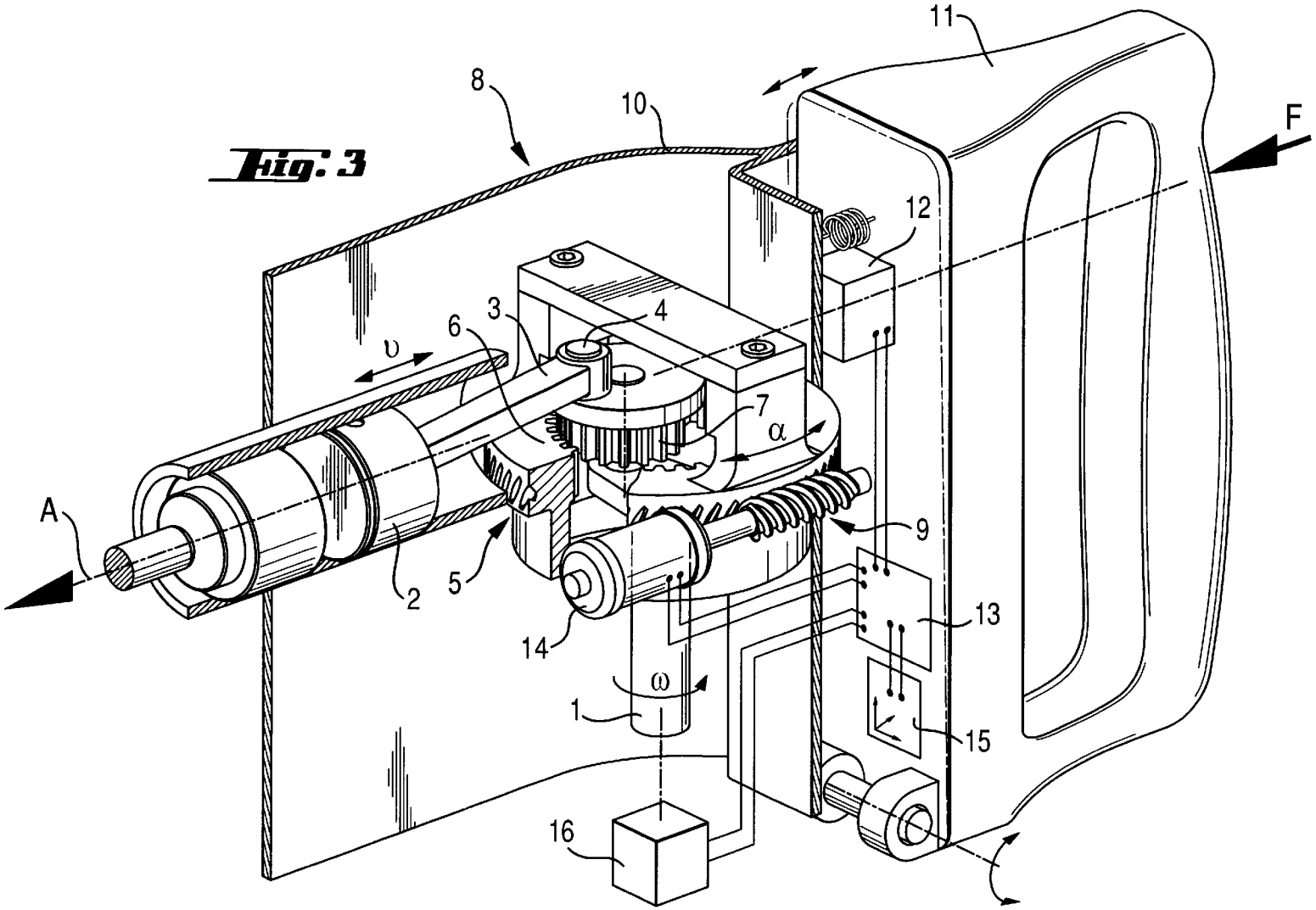
FIG. 3 a perspective, partially cross-sectional view illustrating the principle of controlling the operation of the percussion mechanism.

As shown in FIG. 1, for transforming a rotational movement $\omega$ of a drive shaft 1 in an oscillating movement $\upsilon$, transverse thereto and parallel to a working tool axis A which lies in a plane of the drive shaft 1, of a percussion—generating means, e.g., of a driving piston 2 of a pneumatic percussion mechanism, there is provided a cycloid planetary gear unit 5. The driving piston 2 is connected, by a connecting rod 3, with a journal 4 of the planetary gear unit 5 and which is displaceable along a straight line defined as a particular case of a cycloidal path by a setting $\alpha$. Thus, starting from a reciprocating movement of the journal 4 transverse to the plane of the driveshaft 1 over the setting $\alpha$ of the planetary gear unit 5 from a $\alpha$=[o, $\pi/2$] a monotonic continuous changing of an amplitude of the reciprocating movement of the driving piston 2 in a region from zero (up to idle movement determined by the trigonometry of a finite length of the connecting rod 3) up to the maximum amount of the orbital diameter of the planetary gear unit 5 becomes possible, with the amplitude being approximately proportional to a sinus of an angle defined by the setting $\alpha$. In this way, for a predetermined rotational speed, by adjusting the setting $\alpha$, the amplitude of the oscillations $\upsilon$ and, thus, of the impact power, can be continuously adjusted. The proposed solution also includes a no-impact disconnection with an amplitude close to zero.

According to FIG. 2, the planetary gear unit 5 is so formed that a continuously adjustable sun gear 6, which is formed as a ring gear with inner toothing, has a diameter 2r, and a planetary gear 7, which is provided with outer toothing and which revolves within the sun gear 6, has a diameter r. When the drive shaft 1 drives the axle of the planetary gear 7, the journal 4, which is provided on a radially outer edge of the planetary gear 7, performs a rectilinear reciprocating movement which is a particular case of a generally cycloidal path. By adjusting the setting d of the adjustable sun gear 6, the direction of this reciprocating movement can be continuously adjusted.

As shown in FIG. 3, a self-worm gear unit 9 is provided on the circumference of the sun gear 6 of the planetary gear unit 5. For adjusting the setting $\alpha$ of the adjustable sun gear 6, there is provided a piezo-force sensor 12, which is secured on the housing 10 of the hand-held 8, for measuring an axial force F applied to the handle 11. In response to measuring the force, the piezo force sensor 12 generates a control signal which is communicated to a microcontroller 13 as a set value by appropriate measurement means. The microcontroller 13, in response to the control signal generated by the piezo force sensor 12, calculates, by an appropriate non-linear mapping of the axial force F, the setting a of the planetary gear 5 necessary to obtain a needed impact power. The necessary setting $\alpha$ of the planetary gear unit 5 relative to the housing 10 is effected by driving the worm gear unit 9 with an adjusting motor 14. A gradient sensor 15, which is associated with the microcontroller 13, determines the operational direction A of the hand-held tool 8 for correcting the set value with respect to the axial force at the known own weight of the tool 8. An operational data sensor 16 is used for determining the rotational speed and the torque of the drive shaft 50, and it generates respective signals communicated to the microcontroller 13. In accordance with these signals, the microcontroller 13 determines, based on a performance diagram, an optimal or corresponding to the axial force F, diagram. Advantageously, other operational parameters are also evaluated and are taken into consideration during calculation of the impact amplitude.

According to the present invention, in the first step, actual operational data are determined with the operational data sensor 16 and communicated to the microcontroller 13. In the second step, the microcontroller 13 calculates the setting $\alpha$ necessary to achieve an impact amplitude corresponding to the set impact power. The set impact power is generally put in manually into the microcontroller 13 and is corrected, advantageously, in accordance with the data communicated by the gradient sensor 15. Alternatively, an optimal impact power can be determined based on the performance diagram and the underlying mapping of the axial force. In the third step, for changing the setting $\alpha$, the microcontroller 13 actuates the adjusting motor 14 that correspondingly adjusts the position of the planetary gear unit 5. Advantageously, in the last step the microcontroller 13 calculates based on the data communicated by sensors, the actual impact power of the percussion mechanism compares it with the set value, and adjusts the setting $\alpha$ on the planetary gear unit 5 in accordance with the comparison results.

Though the present invention was shown and described with references to the preferred embodiment, such are merely illustrative of the present invention and are not be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A percussion electrical hand-held tool, comprising a housing (10); a handle (11) secured to the housing (10); percussion means (2) for applying impacts to a working tool and located in the housing (10); a drive shaft (1) for driving the percussion means (2); a planetary gear unit (5) located in the housing (10) and operatively connected with the drive shaft (1) and the percussion means (2) for converting a rotational movement ($\omega$) of the drive shaft (1) into a reciprocating movement ($\upsilon$) of the percussion means (2), the planetary gear unit (5) including a sun gear (6) changing of a setting ($\alpha$) of which provides for adjusting of an impact amplitude of the reciprocating movement ($\upsilon$) of the percussion means (2); and means located in the housing (10) for adjusting the impact amplitude in accordance with a manual axial force (F) applied to the handle (11).

2. A percussion electrical hand-held tool according to claim 1, wherein the percussion means (2) is formed as a driving piston of a pneumatic percussion mechanism.

3. A percussion electrical hand-held tool according to claim 1, further comprising a self-locking worm gear unit (9) for adjusting a position of the sun gear (6) relative to the housing (10), whereby the impact amplitude can be adjusted.

4. A percussion electrical hand-held tool according to claim 1, further one of adjusting motor (14) and servo control means for adjusting a position of the sun gear (6) relative to the housing (10), whereby the impact amplitude can be adjusted.

5. A percussion electrical hand-held tool according to claim 4, further comprising a microcontroller (13) for controlling operation of the one of the adjusting motor (14) and the servo control means.

6. A percussion electrical hand-held tool according to claim 5, further comprising a sensor (16) for acquiring operational data and communicating the operational data to the microcontroller (13), the microcontroller (13) providing for optimal adjustment of the impact power in accordance with the operational data and a readable performance diagram.

7. A percussion electrical hand-held tool according to claim 6, further comprising a gradient sensor (15) for determining an operational direction of the tool and associated with the microcontroller (13), whereby the microcontroller determines a true set value for the impact power and which is not falcified by a gravity acceleration.

8. A percussion electrical hand-held tool according to claim 1, wherein the handle (11) is secured to the housing (10) with a possibility of a limited rotation in a plane transverse to a working tool axis (A), and is axially preloaded whereby the handle (11) is capable of a limited axial displacement upon application of the manual axial force (F) thereto.

* * * * *